US005351593A

United States Patent [19]

Ostendorf

[11] Patent Number: 5,351,593

[45] Date of Patent: * Oct. 4, 1994

[54] MUSICAL WIND INSTRUMENT WITH INNER HORN ASSEMBLY

[76] Inventor: Philip J. Ostendorf, 3331 SE. Fairway West, Stuart, Fla. 34997

[ * ] Notice: The portion of the term of this patent subsequent to Jul. 28, 2009 has been disclaimed.

[21] Appl. No.: 920,345

[22] Filed: Jul. 27, 1992

Related U.S. Application Data

[63] Continuation-in-part of Ser. No. 561,524, Aug. 2, 1990, Pat. No. 5,133,238.

[51] Int. Cl.[5] ..... G10D 7/10

[52] U.S. Cl. ..... 84/387 R

[58] Field of Search ..... 84/387 R, 387 A, 388–401; D17/10–13

[56] References Cited

U.S. PATENT DOCUMENTS

| | | | |
|---|---|---|---|
| 903,059 | 11/1908 | Conn . | |
| 962,574 | 6/1910 | Kaufman . | |
| 982,732 | 1/1911 | Lehnert . | |
| 1,301,147 | 4/1919 | Magin . | |
| 1,338,108 | 4/1920 | Sordillo . | |
| 1,342,846 | 6/1920 | Santa Emma . | |
| 1,362,326 | 12/1920 | Kidder . | |
| 1,445,115 | 2/1923 | Turner . | |
| 2,059,898 | 11/1936 | Osborne . | |
| 2,244,205 | 6/1941 | Koeder . | |
| 2,470,597 | 5/1949 | Woodward . | |
| 3,529,505 | 9/1970 | Brooks | 84/387 |
| 4,273,021 | 6/1981 | Mackie . | |
| 4,273,022 | 6/1981 | Bell . | |
| 4,516,464 | 5/1985 | Hastings | 84/387 R |
| 4,885,971 | 12/1989 | Ostendorf | 84/387 |
| 5,133,238 | 7/1992 | Ostendorf | 84/387 R |

FOREIGN PATENT DOCUMENTS

| | | |
|---|---|---|
| 47280 | 6/1909 | Switzerland . |
| 2766 | of 1858 | United Kingdom . |

OTHER PUBLICATIONS

Montague, "The World of Romantic Modern & Musical Instruments", The Overlook Press, Woodstock, N.Y., 1981, pp. 76–81 and 92–94, Title and Copyright Page.

*Primary Examiner*—William M. Shoop, Jr.
*Assistant Examiner*—Jeffrey W. Donels
*Attorney, Agent, or Firm*—Roger S. Dybvig

[57] ABSTRACT

A musical instrument which may be used to play a complete major scale without coordinated mouth and finger operations has a single mouthpiece, an outer tubing assembly or horn connected to the mouthpiece and terminating in a bell, and an inner horn assembly mounted within the outer horn. The inner horn assembly includes at least one inner horn having an open, upstream end located inside the outer horn and either an open or a closed downstream end adjacent the belled end of the outer horn. If open, the downstream end of the inner horn is either belled or tubular. The inner horn assembly preferably has four straight inner horns, each of which is closed at its distal end by an end cap, each inner horn being tuned to a pitch which is required to produce a required scale frequency of the outer horn and having a length substantially equal to one-fourth the wave length of the pitch to which it is tuned. A method of determining the resonant pitch of each inner horn is also included.

25 Claims, 2 Drawing Sheets

MUSICAL WIND INSTRUMENT WITH INNER HORN ASSEMBLY

CROSS-REFERENCE TO RELATED APPLICATION

This is a continuation-in-part of my application, Ser. No. 07/561,524, filed Aug. 2, 1990, for MUSICAL WIND INSTRUMENT, which will issue as U.S. Pat. No. 5,133,238 on Jul. 28, 1992.

INCORPORATION BY REFERENCE

The disclosure of my aforementioned application Ser. No. 07/561,524, and U.S. Pat. No. 5,133,238, is hereby incorporated by reference herein. The patent is hereinafter referred to as "the '238 patent".

BACKGROUND OF THE INVENTION

This invention relates broadly to wind operated musical instruments and particularly to those musical instruments which are resonant in response to vibrating air columns induced therein to produce tones of various different pitches.

In accordance with the invention disclosed in the '238 patent, a musical instrument is provided that comprises a single mouthpiece, a hollow, outer tubing assembly or horn connected to the mouthpiece and terminating in a bell, and an inner horn assembly comprising an inner horn mounted within the outer tubing assembly at its belled end. The inner horn has an open, upstream end located inside the outer horn and either an open or a closed downstream end projecting outwardly from the belled end of the outer horn. If open, the downstream end of the inner horn could be belled or tubular. In the preferred embodiment disclosed in the '238 patent, the inner horn is in the form of a straight tube which is closed at its outer end by a cap.

It is known that sound vibrations are created at an inlet or mouthpiece of a wind instrument are channeled through an elongated tube whose effective length is configured, that is, lengthened or shortened, to create resonance therein so as to amplify the sound vibrations. The frequencies of the vibrations at which a wind instrument is resonant depend upon the length of the instrument, that is, the length of the tube between its air inlet and its air outlet. This length determines, but is not quite equal to, the effective length of the air column in which the sound waves are formed that, at certain frequencies, cause the instrument to resonate and thereby amplify the sound output of the instrument. To resonate at any given frequency, a conventional instrument must have an effective air column equal in length to an integral multiple of one-half of the wave length of that frequency. This forms the basis for the so-called "harmonic series" of notes that can be resonant and amplified by an instrument having an air column of a given effective length, which series may be expressed by the series of fractions $\frac{1}{2}$, 2/2, 3/2, 4/2 . . . n/2, wherein the numerator represents the number of one-half waves formed in the air column.

The common bugle has a single fixed length and is, therefore, capable of resonating only at frequencies within a single harmonic series. It cannot be used to produce a complete major or minor scale. In order to produce major and minor scales and also complete chromatic scales, most wind instruments are provided with mechanisms to change the tube and effective air column Lengths. Such mechanisms usually comprise telescoping slides, openable ports, or depressible or rotatable valve keys to provide openings to differing combinations of tubing sections. Because of the ability to change the effective air column lengths, the instruments can be used to produce multiple sets of harmonic series and thereby to produce complete chromatic scales.

The frequency, and therefore the pitch, of vibration of a wind instrument depends upon the frequency of the input to the instrument. Typically, a wind instrument, including its mouthpiece, is so constructed that one may produce frequencies beginning with the first or second harmonic number and, depending upon the skill of the musician, extending upwardly through several harmonic numbers. One may change the inlet openings so that the frequencies produced tend to be in the higher harmonic ranges. For example, an instrument made by equipping a bass horn with a conventional trumpet mouthpiece may not be usable to play the lower harmonics but could be used for playing higher harmonics than can be obtained using a conventional bass horn mouthpiece. This is because the bass horn mouthpiece is designed to enable one to vibrate the lips at lower frequencies than possible with a trumpet mouthpiece, at the expense of higher frequencies available using a trumpet mouthpiece.

As those skilled in the art are aware, the number of scale notes between the members of a harmonic series decreases as the harmonic number increases. If the harmonic number is raised high enough, an instrument will play adjacent half tone notes. (At even higher harmonics, an instrument would play quarter tones.) This phenomena has been applied since the days of Bach to the manufacture of "natural horns" which, as with bugles, may not have mechanisms to change the length of the instrument tubes but, because they have relatively small mouthpieces in relation to the lengths of their tubes, are readily played in the higher harmonic ranges, from about 5/2 or 6/2 to about 20/2, and can be used to play imperfect scales. (Some of the natural horns may have had one or two small ports used to adjust off-pitch tones.)

Natural horns have the advantage of being playable without manipulation of tube length-changing mechanisms but they are not in general use. This is probably due, at least in part, to their inability to satisfactorily produce a complete scale. A problem with musical wind instruments capable of playing complete scales is that they require considerable skill, patience, and practice to play. Not only must musicians be dexterous with their fingers to reconfigure the instrument tubes, they must also memorize all of the proper positions and coordinate them with their lip movements.

An object of this invention is to provide a musical wind instrument which may be used to play more notes than possible with a conventional instrument having a fixed tube length but which is simpler to play than conventional wind instruments having mechanisms for changing their tube lengths. In a particular aspect of this invention, an object is to provide a musical wind instrument which may be used to play a complete major scale without coordinated mouth and finger operations.

In another aspect of this invention, an object is to provide a musical wind instrument which may be used to produce a complete chromatic scale with a minimum of coordinated mouth and finger operations.

The foregoing objects of this invention are generally the same as the objects of the '238 patent. In accordance with the invention disclosed therein, a musical instrument is provided which comprises a single mouthpiece, a hollow, outer tubing assembly or horn connected to the mouthpiece and terminating in a bell, and an inner horn assembly mounted within the outer tubing assembly at its belled end. In the preferred embodiment disclosed therein, the inner horn assembly comprises a single, tubular inner horn having an open, upstream or proximal end concentrically located inside the outer horn and a closed downstream or distal end located ,adjacent the belled end of the outer horn. In related embodiments, the inner horn can have an open downstream or distal end which can be either belled or tubular. Furthermore, the use of two concentric inner horns for producing additional scale notes was contemplated although I believed at the time the application for the '238 patent was filed that the use of two or more inner horns would be impractical and unnecessary.

Although a musical instrument constructed in accordance with the invention as described in the '238 patent can be somewhat successful in meeting the objects of the invention, such an instrument produced still-retained unpleasant off key notes (e.g. 11/2, 13/2 and 14/2), and would probably be of doubtful commercial utility. Accordingly, a further object of this invention is to improve upon the invention described in the '238 patent.

Another object of this invention is to provide a method for producing an inner horn assembly including a method for determining the length of inner horns thereof.

Other objects of this invention are to provide a wind instrument having a reasonably consistent timbre, playable over a two octave range, having a reasonably true pitch, and playable loud enough to be useful without unduly straining the musician playing it—that is, a wind instrument that is pleasant to listen to and easy to play.

SUMMARY

In accordance with this invention, a musical instrument is provided which comprises a single mouthpiece, a hollow, outer tubing assembly or horn connected to the mouthpiece and terminating in a bell, and an inner horn assembly mounted within the outer tubing assembly at its belled end.

In the presently preferred embodiment, the inner horn assembly comprises four inner horns of mutually different lengths, each comprising a straight tube closed at its downstream or distal end. The horn assembly could comprise one, two or three inner horns to obtain improvements over an instrument comprising an outer horn having no inner horns at all. Also, it is conceivable that a useful inner horn assembly could have more than four horns. However, it is presently believed that the greatest enhancements will be obtained with exactly four inner horns.

Tests have shown that the inner horn assembly provides two beneficial results: additional scale tones can be produced without the use of valves or slides and the pitch of certain off key tones produced by the outer horn alone can be corrected (either depressed or elevated) to be "on key". Although there may be other reasons why an inner horn assembly can correct and add tones, my present belief is that the additions of tones results from an averaging of tones produced by the adjacent natural pitches produced by the outer or external horn and the resonant pitches of the inner or internal horns. Corrections of tones, i.e., the lowering or raising of pitches naturally produced by the outer horn are caused by the partial obstruction of the air column of the outer horn by the individual horns of the inner horn assembly, similar to the adjustments of pitch of a French horn obtained by the insertion of musician's hand into the bell.

The four inner horns are preferably of such a length that each contributes to the production of a tone which is not producible using the outer horn alone, and in particular, the four inner horns contribute, respectively, to the production of the "Ti" immediately below the 6/2 harmonic, the "Mi" immediately below the 8/2 harmonic, the "La#" immediately below the 11/2 harmonic, and the "Do#" immediately below the 13/2 harmonic. (In the following description and claims, to avoid the need to repeat the full designation of the foregoing specific tones, they are referred to simply as "Ti", "Mi", "La#", and "Do#" without indication as to their relationship to the particular harmonics. Thus, for example, the word "Ti" hereinafter refers only to that particular "Ti" which is immediately below the 6/2 harmonic, and so forth.)

As to determining the length of an inner horn for producing a tone which would otherwise be unplayable, the following method is preferred. First, the frequency of the tone desired to be added is determined. These are well known to the art. The frequency at which an inner horn should resonate by itself is then computed by the formula:

$$IH=3DF-(OH1+OH2)$$

where IH is the frequency at which the inner horn should resonate, DF is the desired frequency of the tone to be added, OH1 is the frequency of the next higher harmonic produced by the outer horn alone and OH2 is the frequency of the next lower harmonic produced by the outer horn alone. This formula arises from my discovery that the desired frequency is equal to the average of IH, OH1, and OH2. In practice, an inner horn frequency need not be equal precisely to the calculated frequency, but any variation of more than several cycles per second will be detrimental to the production of the desired tones.

Each inner horn is inserted into the bell of the outer horn to a depth that produces the optimal pitch, as determined by trial and error. The optimal pitch obtains when any added pitch is produced with maximum clarity and adjacent pitches are maximally enhanced (or minimally disturbed) by the presence of the inner horn. In general, the distal end of each inner horn will be close to the distal end of the bell of the outer horn. However, the distal end of an inner horn may extend downstream, be even with, or even be located proximally or upstream of the belled end of the outer horn.

The optimal length of an open-ended inner horn is equal to approximately one half of the wave length of the tone to which such inner horn is pitched. (The precise length will differ from one-half wave length only by the amount needed to produce the desired pitch). A tube of longer length would usually be unacceptable to assemble into an outer tubing. When made from a tube capped at its outer end, as is presently preferred, the length of an inner horn is approximately one-fourth the wave length of the tone to which the inner horn is pitched, again differing from precisely one-fourth wave length only as needed to produce the desired pitch. The capped tube can be shorter, as will be recognized by those skilled in the art, because it produces a reflected wave. It is the short length of the capped tube which makes its use preferable to an open-ended tube.

In a preferred practice of this invention, a mouthpiece is used which enables the two horns to be played without substantial difficulty in a range of frequencies beginning at the 5/2 harmonic and extending through the 20/2 harmonic. Such an instrument with an outer horn and an inner horn assembly having four inner horns can be used to play two octaves of a complete major scale.

Further in accordance with another aspect of this invention, the outer horn may be provided with a normally closed (by keys or the musician's fingers) "accidentals" port adjacent its distal or free end for producing sharps and flats, and thereby permit the playing of a complete chromatic scale. The accidentals port, if used, is spaced to provide musical intervals of half tones of higher pitch with respect to the originating horn pitch. Optionally, another "scale" or range-extending port spaced from the accidentals port to provide an additional half tone higher range to the instrument could also be provided near the belled end of the outer tube. The location of the port or ports may be made adjustable to permit slight changes in tuning to accommodate other instruments of fixed pitch when playing in concert.

Each inner horn may optionally have a telescoping slide for adjusting its length to adjust the pitch that it contributes to correcting or adding. Each inner horn may also be adjustable to different lengths relative to the distal end of the outer horn to adjust the pitch of the instrument.

In another aspect of this invention, an attachment may be provided that adds an inner horn assembly having up to four inner horns, as described above, to an existing horn to convert the existing horn to an instrument capable of playing a major scale without the use of valves or slides.

Other objects and advantages will become apparent from the following description of the drawings.

DETAILED DESCRIPTION

Figure 1:
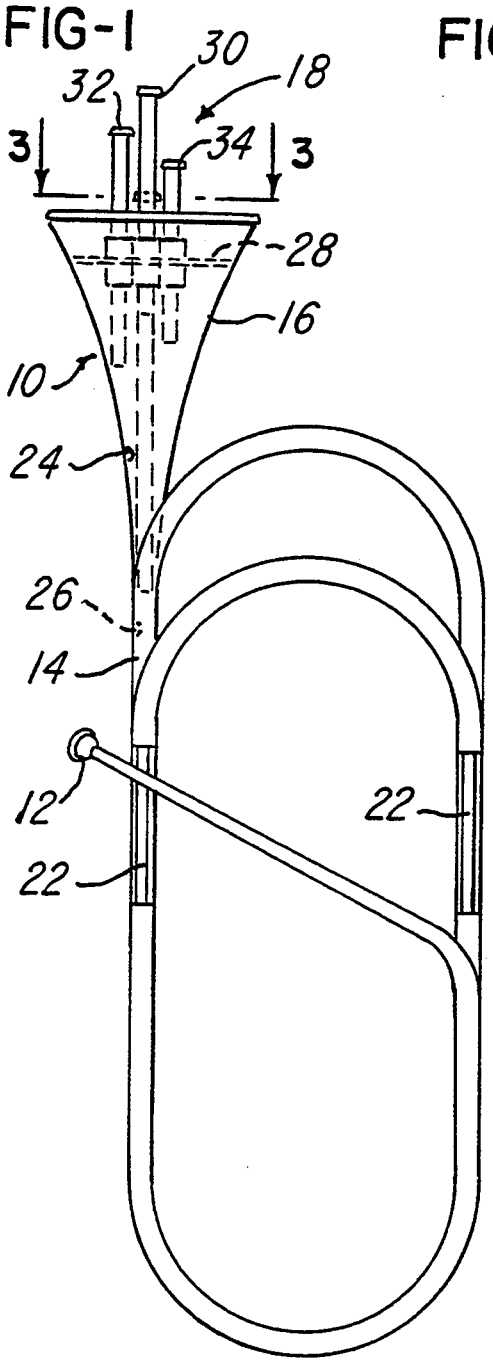
FIG. 1 is an elevational view of a musical wind instrument in accordance with the presently preferred embodiment of this invention.
Figure 2:
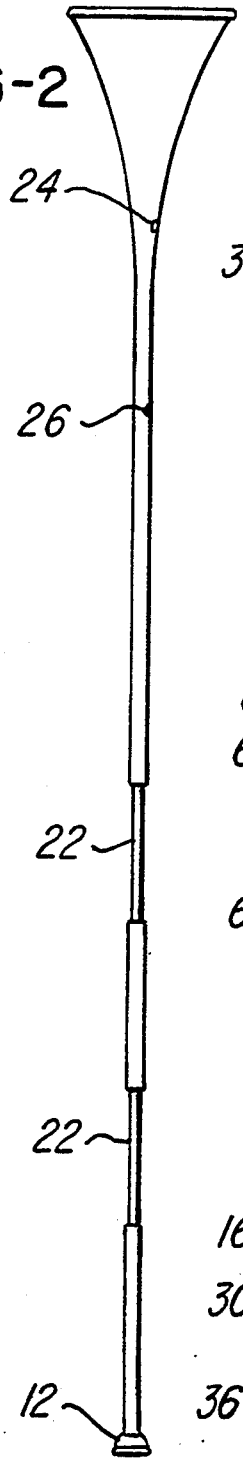
FIG. 2 is a diagrammatic view of the outer horn of the instrument of FIG. 1 shown as if unbent from the shape shown in FIG. 1.
Figure 3:
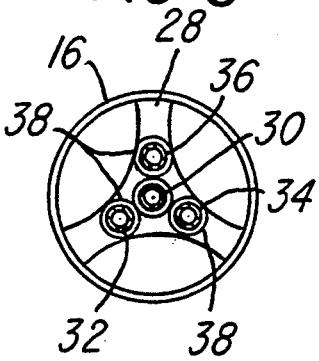
FIG. 3 is a plan view of the belled end of the instrument of FIG. 1 with the inner horn assembly shown in a cross section taken along line 3—3 of FIG. 1.

A first, and presently preferred, embodiment of a musical wind instrument 10 in accordance with this invention is shown in FIGS. 1, 2, and 3 to comprise a single inlet in the form or a cup-shaped mouthpiece 12, a first, hollow outer tubing assembly or horn 14 having a proximal end connected and opening to the distal end of the mouthpiece 12 and a distal end terminating in a bell 16, and further comprising an inner horn assembly, generally designated 18, mounted at the distal end of the outer horn 14 and having a proximal end opening inside the outer horn 14 and a distal end projecting outwardly of the bell 16.

The outer horn 14 may be provided with conventional tuning slides 22 and an "accidentals" port 24 for sharps and flats, as will be further discussed below, and a "scale" or range-extending port 26, both ports being near the belled end 16 of the outer horn 14. As will be described below, only one, or neither one, of the ports 24 and 26 need be provided.

The inner horn assembly 18 includes a spider 28 which may be affixed, as by brazing, to the inside surface of the belled end of the outer horn 14.

With reference to FIGS. 1 and 3, the inner horn assembly 18 comprises a set of four parallel inner horns or tubes 30, 32, 34, and 36 mounted side-by-side in slide bearings or mounting tubes 38 affixed to the spider 28.

Although various different combinations of horn lengths could be used, the following criteria appear to be optimal for an instrument 10 capable of playing two octaves of a complete major scale.

1. An outer horn 14 having an effective air column length equal to the sound velocity in the ambient air conditions divided by the fundamental (2/2) frequency of the horn.
2. A mouthpiece providing an air inlet to the outer horn sized to enable one to play without substantial difficulty in a range of frequencies beginning at the 5/2 harmonic and extending through the 20/2 harmonic.
3. An inner horn assembly 18 having its four inner horns 30, 32, 34, and 36 capped at their distal ends and pitched, respectively, to cause the "Ti", the "Mi", the "La#×, and the "Do#" frequencies of the outer horn 14 to sound, and each of a length that is substantially equal to one-fourth the wavelength of the harmonic to which it is pitched.
4. Each inner horn is positioned at a distance from the mouthpiece to obtain the optimal pitch as defined above.

An example of a musical wind instrument which may be made with accordance with this invention would be a horn that is in the trombone playing range, that will play the key of "F", will have as its low scale note "Do" the F which has a frequency of 174.61 cycles per second and be the 6/2 harmonic of the external horn. The fundamental (2/2) pitch will be the 8/2 harmonic at 233.08 cycles per second divided by 8 then multiplied by 2 or 58.27 cps which is A#1. The interval between the family of pitches is 58.27 divided by 2 or 29.14 cps. The air column length of the horn is 19.51 feet at certain conditions of temperature, pressure, humidity and horn friction. The comparison of the scale note, scale frequency, scale note letter, exterior horn frequency, and harmonic family member number are as listed below in Table 1.

TABLE 1

| SCALE NOTE | SCALE FREQUENCY | OUTER HORN FREQUENCY | INNER HORN FREQUENCY | FREQUENCY CREATED OR ADJUSTED |
|---|---|---|---|---|
| La | 146.83 D | 145.67 5/2 | | |
| " # | 155.56 D# | | | |
| Ti | 164.81 E | | | 164.81 c. |
| Do | 174.61 F | 174.81 6/2 | 173.95 1/4 1 | |
| " # | 184.99 F# | | | |
| Re | 195.99 G | | | 195.99 a.7/2 |
| | | 203.95 7/2* | | |
| " # | 207.64 G# | | | |
| Mi | 220.00 A | | 222.97 1/4 2 | 220.00 c. 1 |
| Fa | 223.08 A# | 233.08 8/2 | | |
| " # | 246.94 B | | | |
| So | 261.62 C | 262.22 9/2 | | |
| " # | 277.17 C# | | | |
| La | 293.66 D | 291.35 10/2 | | |
| " # | 311.12 D# | | | 311.12 c. 2 |
| | | 320.48 11/2* | | |
| Ti | 329.62 E | | 321.53 1/4 3 | 329.62 a.11/2 |
| Do | 349.21 F | 349.62 12/2 | | |
| " # | 369.99 F# | | | 369.99 c. 3 |
| | | 378.76 13/2* | 381.59 1/4 4 | |
| Re | 391.99 G | | | 391.99 a. 13/2 |
| | | 407.89 14/2* | | |
| " # | 415.29 G# | | | 415.89 a. 14/2 |
| Mi | 440.00 A | 437.03 15/2 | | |
| Fa | 466.16 A# | 466.08 16/2 | | |
| " # | 493.87 B | 495.27 17/2 | | |
| So | 523.24 C | 524.34 18/2 | | |
| " # | 554.37 C# | 553.47 19/2 | | |
| La | 587.33 D | 582.60 20/2 | | |

Table notes:

*Comparing the Scale Frequency with the Outer Horn Frequency it is obvious that the outer horn normal harmonic family member is too far off pitch to be usable in good music. These notes must be adjusted.

The designation of 1/4 2 refers to the 1st harmonic of a one quarter wave length of the second inner horn.

The designation of 6/2 refers to the 6th harmonic of a one half wave length outer horn.

Frequency values of the inner horns are computed using the formula stated above. If the frequency of 173.95, is produced in a quarter wave length inner horn, there will be an entirely new pitch of 164.81 cps synthesized. (174.81 outer horn + 145.67 outer horn + 173.95 inner horn)/3 = 164.81. This is the note "Ti" which is needed to assist in forming a two octave major scale. There is also the phenomena of slightly depressing the 5/2 harmonic and elevating the 6/2 harmonic. (Changes in the positioning of the inner horn will adjusts the depression and elevation.

By producing a 1/4 2, 222.97 cps quarter wave length inner horn and inserting it into the belled end of the outer horn, a 220.00 cps note becomes available for producing the "Mi" of the major scale. Positioning for the maximum depression of the unusable 7/2 harmonic of the outer horn causes a usable 7/2 "Re" to be adjusted into the major scale.

By producing a 1/4 3, 321.53 cps quarter wave length inner horn and inserting it into the belled end of the outer horn, a new 311.12 cps note is created that is not required for the major scale. There is, however, an elevation of the unusable 11/2 to 329.62 cps, which is the required upper "Ti" of the major scale.

By producing a 1/4 4, 381.59 cps quarter wave length inner horn and inserting it into the bell end of the outer horn, a new 369.99 cps note is created that is not required for the major scale. There is, however, an elevation of the unusable 13/2 to 391.99 cps, which is the required upper "Re" of the major scale, and the unusable 14/2 is elevated to 415.29 cps, which is the "Re#" required for the chromatic scale.

As Table I and the accompanying notes reveal, an instrument made in accordance with this invention can be used to play two octaves of a major scale without the use of hand controlled devices such as valves, ports or slides to achieve the missing components of the major scale produced by a natural horn. The objects of the invention are thus achieved.

Using the foregoing criteria, the outer horn 14 alone could be used to produce most of the scale tones but there will be missing and off-key notes.

Inner horn 30 creates the missing "Ti" below the 6th harmonic. Inner horn 32 depresses the external horn 7th from an unusable pitch to a usable "Re" and creates a new "Mi"

Using inner horn 34, the badly pitched 11th of the outer horn 14 is elevated to be a usable upper "Ti" of the scale, and "La#" is created.

With the fourth inner horn 36, the badly pitched 13th and 14th harmonics are elevated to produce a usable "Re" and "Mi", and creates a new "Do#".

In sum, the preferred inner horn assembly enables the instrument 10 to be used to play two octaves of an acceptable major scale merely by the control of the "lip buzz" of the musician and without the manipulations needed to modify tubing lengths.

The optimal distances of the inner horns from the mouthpiece 12 can be obtained by trial and error and, because opinions as to the effects desired to be produced will differ, the optimal positions of the inner horns will depend to some extent upon the preferences of the horn manufacturer or the musician playing the horn. Experience has indicated that the distal ends of capped inner horns should usually be located within a few inches, either proximally or distally, from the distal end of the bell 16. To enable adjustment of this distance, each of the inner horns is preferably slidably mounted within its respective mounting tube 38 and may be held in place by friction, perhaps with detents (not shown) or other suitable friction or clamping devices. When determining the positions of the inner horns, care should be taken to determine not only that any desired new scale tone is added by an inner horn but also that any beneficial effect on adjacent notes be maximized to the extent possible and that any detrimental effect on adjacent notes be minimized to the extent possible by appropriate adjustment of the position of the inner horn. Based on experience to date, a change in the position of each inner horn has an effect only upon a few notes near to its pitch and, when adjusting the position of one inner horn, it is essentially unnecessary to be concerned with the effect the positions of the other inner horns may have.

The accidentals port 24 located in the outer horn tubing 16, when opened, produces an effective air column length equal to the sound velocity in the ambient air conditions divided by the fundamental (2/2) frequency of the next higher scale one-half tone above the external horn fundamental (2/2) frequency of the outer horn 14, would enable one to use the horn 10 to play an acceptable two-octave chromatic scale. Referring to horn of Table 1 as an example, it will be apparent that a complete chromatic scale, that is, a major scale with all of the required sharps and flats (accidentals) can be produced if an accidentals port 24 is added in the side of the bell to reduce the air column length of the exterior horn to 18.42 feet, thereby enabling the production of a harmonic family of pitches based upon 61.74 cps.

Those familiar with the art will understand that the effective air column lengths stated above are approximations. The precise lengths will depend upon the temperament or intonation desired by the manufacturer. As will be understood, the outer horn may be cylindrical or conical, or partly each, depending on the desired timbre.

The scale port 26, if provided, preferably has an effective air column length equal to the sound velocity in the ambient air conditions divided by the fundamental (2/2) frequency of the next higher scale whole tone above the external horn fundamental (2/2) frequency. The scale port 26 adds only an extra note and may, for the sake of simplicity, be omitted with little detrimental effect. The accidentals port 24 is necessary for the instrument 10 to be capable of playing a complete chromatic scale and can be omitted if only a major scale capability is desired.

To achieve precisely the desired air column lengths under various different atmospheric conditions would require that tuning adjustments be provided for both the outer horn 14 and the inner horns. Thus, in addition to the tuning slides 22, which enable tuning of the outer horn 14, the inner horns may also be provided with conventional tuning slides (not shown).

Figure 7:
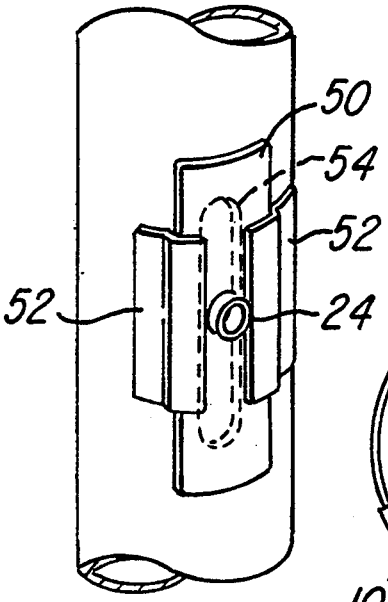
FIG. 7 is an enlarged, fragmentary perspective view illustrating an adjustable port with which an instrument of this invention may be provided.

As shown in FIG. 7, the accidentals port 24 may be located in a manually slidable plate 50 frictionally retained and guided by gibs 52. As is apparent, the ported plate 50 is slidable over a portion of the tubing 14 which is provided with an elongated slot 54. As will be readily understood, the adjusted position of the port 24 will determine the effective length of the air column created when the port 24 is opened while the instrument 10 is being played. Of course, the port 26, if used, could be made adjustable in the same manner. Notwithstanding the foregoing discussion concerning tuning adjustments, full tuning capability may not always be desired, especially because it is important to maintain the positions of the inner horns relative to the outer horn 14, which makes it difficult to obtain fully complete tuning.

Figure 10:
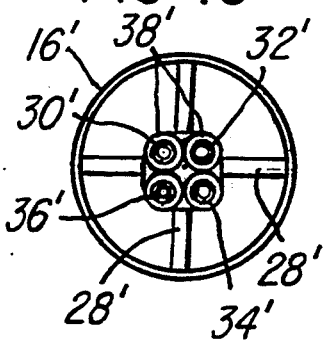
FIG. 10 is a plan view similar to FIG. 3 of the belled end of a musical instrument with a modified inner horn assembly shown in cross section.

As best shown in FIG. 3, the inner horn 30 is concentrically located within the bell 16 and the other inner horns 32, 34, and 36 are arranged in a circular array about the axis of the inner horn 30, and spaced from one another by 120 degrees. This arrangement of the inner horns is not critical; they need not be concentrically located within the bell 16 nor need they be in a circular array. FIG. 10 diagrammatically shows another way, which is simply manufactured and presently preferred, in which four inner horns 30', 32', 34' and 36' are mounted in slide bearings or mounting tubes 38' that are clustered in a rectangular array and mounted by a spider 28' brazed to both the mounting tubes 38' and to an outer horn bell 16'. Optionally, the radially outermost parts of the spider 28' could be bent to form hooks (not shown) for clipping the inner horn assembly as an attachment (not shown) to an existing horn, such as in the embodiments of FIGS. 8 and 9. Other useful arrangements may readily be imagined.

Figure 4:
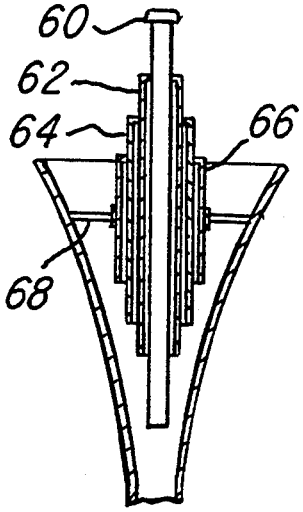
FIG. 4 is a fragmentary, cross-sectional view of a musical wind instrument in accordance with a second embodiment of this invention.

FIG. 4 shows an embodiment wherein four capped inner horn 60, 62, 64, and 66 are located coaxially within an outer horn bell 16 and coaxially within one another. The inner horns in this embodiment are preferably slidable one with respect to the other and the largest diameter inner horn 66 is preferably slidably mounted on a supporting spider 68 in order to enable adjustment of the depth of insertion of the inner horns into the bell 16. The lengths of the inner horns 60, 62, 64, and 66 are preferably selected to provide approximately the "Ti", "Mi", "La#" and "Do#" frequencies of the outer horn for reasons discussed in connection with the first embodiment.

Figure 5:
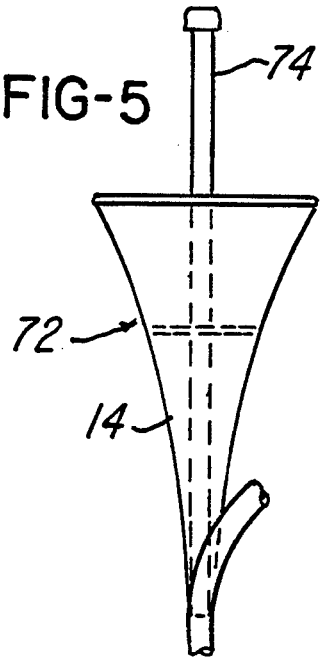
FIG. 5 is a fragmentary, elevational view of a musical wind instrument in accordance with a third embodiment of this invention.

As previously noted, instruments having fewer than four inner horns can provide enhancements not available with an instrument having no inner horns. One example is shown in FIG. 5, wherein an instrument 72 is provided which may have the same outer horn 14 as in the previous embodiments, but only a single inner horn 74. Inner horn 74 is preferably like the inner horn 32 in that it is tuned to produce approximately the "Mi" frequency of the outer horn because that produces the most important improvement of any of the inner horns over a natural horn having no inner horn. Use of a single inner horn tuned to that frequency which, when combined with the outer horn, produces the "Mi" frequency is discussed in the '238 patent. However, it should be noted the use of a single outer horn identical in effect to any one of the other inner horns 30, 34 or 36 would produce a instrument having advantages over a natural horn having no inner horn.

Figure 6:
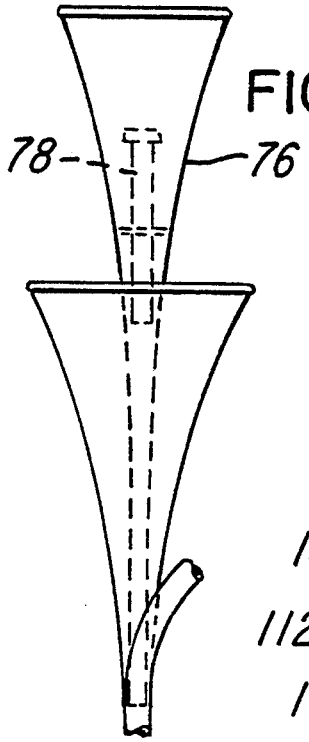
FIG. 6 is a fragmentary, elevational view of a musical wind instrument in accordance with a fourth embodiment of this invention.

FIG. 6 shows another embodiment wherein an outer horn 14 is provided with two concentric inner horns, namely an opened-ended inner horn 76 and a capped tube 78. Note that the open-ended inner horn 76 is longer than any of the other inner horns. This is because an open-ended inner horn must have a length equal to one-half of the wave length of its pitch rather than the one-quarter wave length of capped inner horns. For reasons that will be apparent from the foregoing discussion, at least one of the two inner horns of FIG. 6 is preferably tuned to produce approximately the "Mi" frequency of the outer horn. The other inner horn of FIG. 6 would, accordingly, preferably be tuned, using the method described above, to cooperate to produce the "Ti", "La#", or "Do#" frequency of the outer horn.

Figure 8:
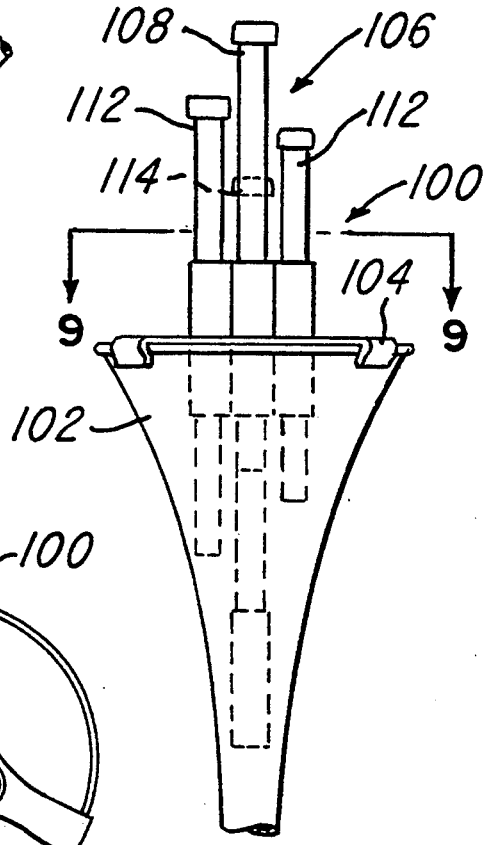
FIG. 8 is a fragmentary, elevational view of an existing musical instrument provided with an attachment made in accordance with an aspect of this invention.
Figure 9:
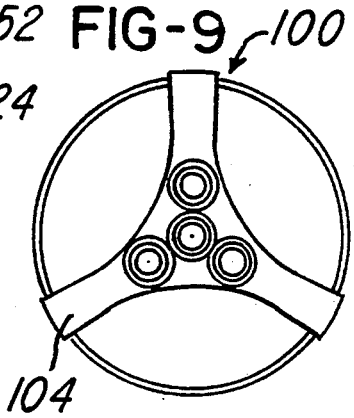
FIG. 9 is a plan view of the belled end of the instrument of FIG. 8 with the attachment in a cross section taken along line 9—9 of FIG. 1.

With reference to FIGS. 8 and 9, an attachment, generally designated 100, to an existing horn 102, such as a trombone, in accordance with an aspect of this invention, comprises a spider-like support member 104 clipped to the end of the existing horn 102 that slidably supports an inner horn assembly 106, which has four capped inner horns 108, 110, 112, and 114, which are constructed in accordance with the same principles as the inner horns of the instrument 10 of FIG. 1. Played with a trumpet mouthpiece in order to render it easy to play the higher harmonics, a trombone instrument 102 provided with the attachment 100 may have characteristics similar to the instrument 10 of FIG. 1. Of course, it will by now be apparent that attachments (not shown) having fewer than four inner horns may be useful, although not as beneficial as the attachment 100.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

1. A musical instrument which may be used to play a scale without coordinated mouth and finger operations comprising a single mouthpiece, an outer horn connected to the mouthpiece and terminating in a bell, and an inner horn assembly mounted on said outer horn at its belled end, said inner horn assembly comprising at least one inner horn having an open, upstream end located inside said outer horn and tuned to produce approximately the "Ti", "Mi", "La#", or "Do#" frequency of the outer horn.

2. The musical instrument of claim 1 wherein said inner horn has a closed distal end.

3. The musical instrument of claim 1 wherein said inner horn comprises a straight tube.

4. The musical instrument of claim 1 wherein said inner horn assembly comprises plural inner horns of mutually different lengths.

5. The musical instrument of claim 4 wherein said inner horn assembly comprises two inner horns.

6. The musical instrument of claim 5 wherein one of said inner horns is tuned to produce approximately the "Mi" frequency of the outer horn and the other inner horn is tuned to produce approximately one of the "Ti", "La#", or "Do#" frequencies of the outer horn.

7. The musical instrument of claim 4 wherein said inner horn assembly comprises three inner horns.

8. The musical instrument of claim 7 wherein one of said inner horns is tuned to produce approximately the "Mi" frequency of the outer horn and the other inner horns are tuned respectively, to produce approximately one of the "Ti", "La#", or "Do#" frequencies of the outer horn.

9. The musical instrument of claim 4 wherein said inner horn assembly comprises four inner horns.

10. The musical instrument of claim 9 wherein said inner horns are tuned, respectively, to produce approximately the "Ti", "Mi", "La#" and "Do#" frequencies of the outer horn

11. The musical instrument of claim 10 wherein each of said inner horns has a closed distal end.

12. The musical instrument of claim 10 wherein each of said inner horns comprises a straight tube.

13. An attachment for a musical horn having a belled end for converting said horn to a musical instrument which may be used to play a scale without coordinated mouth and finger operations, said attachment comprising a support member adopted to be clipped to the bell of the horn, and an inner horn assembly mounted on said support member, said inner horn assembly comprising at least one inner horn having an open, upstream end located inside said outer horn and tuned to produce approximately the "Ti", "Mi", "La#", or "Do#" frequency of the outer horn.

14. The musical instrument of claim 13 wherein said inner horn has a closed distal end.

15. The musical instrument of claim 13 wherein said inner horn comprises a straight tube.

16. The musical instrument of claim 13 wherein said inner horn assembly comprises plural inner horns of mutually different lengths.

17. The musical instrument of claim 16 wherein said inner horn assembly comprises two inner horns.

18. The musical instrument of claim 17 wherein one of said inner horns is tuned to produce approximately the "Mi" frequency of the outer horn and the other inner horn is tuned to produce approximately one of the "Ti", "La#", or "Do#" frequencies of the outer horn.

19. The musical instrument of claim 16 wherein said inner horn assembly comprises three inner horns.

20. The musical instrument of claim 19 wherein one of said inner horns is tuned to produce approximately the "Mi" frequency of the outer horn and the other inner horns are tuned respectively, to produce approximately one of the "Ti", "La#", or "Do#" frequencies of the outer horn.

21. The musical instrument of claim 16 wherein said inner horn assembly comprises four inner horns.

22. The musical instrument of claim 21 wherein said inner horns are tuned, respectively, to produce approximately the "Ti", "Mi", "La#" and "Do#" frequencies of the outer horn.

23. The musical instrument of claim 22 wherein each of said inner horns has a closed distal end.

24. The musical instrument of claim 23 wherein each of said inner horns comprises a straight tube.

25. A method for manufacturing an inner horn assembly for insertion into the belled end of an outer horn or an existing musical instrument to enable the production of one or more tones that the outer horn or instrument is unable to produce without changing the effective air column length of the outer horn, comprising the steps of constructing an inner horn having an effective air column length selected so that it resonates at substantially a frequency computed in accordance with the formula $$IH=3DF-9OH1+OH2)$$

where IH is the frequency at which the inner horn should resonate, DF is the desired frequency of a tone to be added, OH1 is the frequency of the harmonic of the outer horn next higher than the desired frequency of the tone to be added, and OH2 is the frequency of the harmonic of the outer horn next lower than the desired frequency of the tone to be added, and mounting said inner horn to a mounting member.

* * * * *

UNITED STATES PATENT AND TRADEMARK OFFICE

CERTIFICATE OF CORRECTION

PATENT NO. : 5,351,593

DATED : October 4, 1994

INVENTOR(S) : Philip J. Ostendorf

It is certified that error appears in the above-indentified patent and that said Letters Patent is hereby corrected as shown below:

Column 12, line 50, Claim 25, application claim 25, line 9, "9OH1+OH2)" should read --(OH1+OH2).

Column 6, line 51, application page 14, line 14, "La#X," should read --La#--.

Signed and Sealed this

Sixteenth Day of July, 1996

*Attest:*

*Attesting Officer*

BRUCE LEHMAN

*Commissioner of Patents and Trademarks*